US007226236B2

(12) United States Patent
Mertens

(10) Patent No.: US 7,226,236 B2
(45) Date of Patent: Jun. 5, 2007

(54) BARRIER ELEMENT

(75) Inventor: Joseph Peter Hubert Maria Mertens, Brunssum (NL)

(73) Assignee: Laura Metaal Eygelshoven BV, EA Eygelshoven (NL)

( * ) Notice: Subject to any disclaimer, the term of this patent is extended or adjusted under 35 U.S.C. 154(b) by 0 days.

(21) Appl. No.: 10/511,339

(22) PCT Filed: Apr. 14, 2003

(86) PCT No.: PCT/EP03/03925

§ 371 (c)(1),
(2), (4) Date: Jul. 8, 2005

(87) PCT Pub. No.: WO03/087480

PCT Pub. Date: Oct. 23, 2003

(65) Prior Publication Data

US 2005/0249551 A1 Nov. 10, 2005

(30) Foreign Application Priority Data

Apr. 18, 2002 (NL) ..... 1020420

(51) Int. Cl.
*E01F 13/00* (2006.01)

(52) U.S. Cl. ..... 404/6

(58) Field of Classification Search ..... 404/6, 404/9, 10, 11; 256/1, 13.1
See application file for complete search history.

(56) References Cited

U.S. PATENT DOCUMENTS 3,678,815 A * 7/1972 Younker ..... 14/73
3,712,589 A * 1/1973 Peterson et al. ..... 256/13.1
4,681,302 A 7/1987 Thompson ..... 256/13.1
4,954,009 A * 9/1990 Kellison ..... 256/13.1
5,531,540 A * 7/1996 Wasserstrom et al. ..... 404/6
5,611,641 A * 3/1997 Christensen ..... 404/6
5,685,665 A * 11/1997 Lembo ..... 404/6
6,059,491 A * 5/2000 Striefel et al. ..... 405/111
6,164,865 A * 12/2000 McCallum ..... 404/6
6,203,242 B1 * 3/2001 Englund ..... 404/6
6,402,421 B1 * 6/2002 Ottavi et al. ..... 404/6
6,485,224 B1 11/2002 Dyke et al. ..... 404/6
6,712,545 B2 * 3/2004 Muller et al. ..... 404/6
6,851,887 B2 * 2/2005 Lembo ..... 404/6

FOREIGN PATENT DOCUMENTS

| | | |
|---|---|---|
| EP | 1001090 | 5/2000 |
| JP | 2058610 | 2/1990 |
| NL | 1006481 | 1/1999 |
| WO | 9819015 | 5/1998 |

* cited by examiner

*Primary Examiner*—Gary S. Hartmann
(74) *Attorney, Agent, or Firm*—Stevens, Davis, Miller & Mosher, LLP

(57) ABSTRACT

Barrier element for bounding a carriageway, including a guide element extending about a longitudinal axis. The guide element transversely to the longitudinal axis has on the underside a foot part, which on the first end of the guide element has a base plate. The base plate has parts of a tenon and mortise connecting system as the first connector for connecting the barrier element to a second barrier element, provided with parts of a tenon and mortise system as the second connector, which interact with the first connector. The first end of the barrier element has a fixing member for accommodating a fixing element for fixing the barrier element relative to the carriageway.

16 Claims, 6 Drawing Sheets

BARRIER ELEMENT

This application is a §371 National Stage Application of International Application No. PCT/EP03/03925, filed on 14 Apr. 2003, claiming the priority of Netherlands Patent Application No. 1020420 filed on 18 Apr. 2002.

BACKGROUND OF THE INVENTION

The invention relates to a barrier element for bounding a carriageway, comprising a guide element extending along a longitudinal axis, which guide element transversely to the longitudinal axis has on the underside a foot part, which on the first end of the guide element is provided with a base plate, which base plate is provided with parts of a tenon and mortise connecting system as the first connecting means for connecting the barrier element to a second barrier element, which is provided with parts of a tenon and mortise system as the second connecting means, which interact with the first connecting means. Such a barrier element is known from Dutch Patent Application 1006481.

In the case of the known barrier element tenons can be fitted on the base plate as the first connecting means, which can be connected to a base plate provided with mortises so as to form a joint, which base plate forms the second connecting means in a second barrier element which can be connected to the first barrier element. Of course, other combinations and configurations of tenons and mortises are conceivable, as is known from Patent Application 1006481. For the sake of completeness, the full content of this application is deemed by this reference to it to be incorporated in the present description.

It is also known from the abovementioned application to pre-connect several, for example two, barrier elements to form an assembly, in which case use is made of a different connecting system comprising connecting plates and mounting bolts.

It is desirable, after a barrier element or an assembly of barrier elements has been placed on a road surface, to fix said barrier element or assembly of barrier elements relative to the road surface, in order to prevent slipping or tilting if a road vehicle crashes against the barrier element(s).

SUMMARY OF THE INVENTION

It is an object of the invention to provide a barrier element that can be fixed easily relative to the road surface.

It is another object of the invention to provide a barrier element which, as part of an assembly of barrier elements, can be fixed easily relative to the road surface.

It is yet a further object of the invention to provide a barrier element that with few modifications compared with the known barrier elements is suitable for fixing relative to the road surface.

One or more of these objects is achieved with a barrier element that according to the invention is characterized in that on the first end the barrier element is provided with fixing means for accommodating a fixing element for fixing the barrier element relative to the carriageway.

The first end of the guide element, which is provided with the parts for the tenon and mortise connecting system, after positioning of the barrier element is also easily and directly accessible for the fitting of fixing elements after the barrier element has been placed in position. That is also the case if several barrier elements have been combined to form an assembly, for example by using connecting plates and mounting bolts. In that case the first end will be easily and directly accessible even after placing of the assembly. The fitting of the fixing means will consequently add little to the positioning time. Another advantage achieved is that no fitting hatches are necessary in order to reach the interior of the barrier element. A further advantage achieved is that, after the barrier elements have been positioned and connected, the fixing means are shielded by the guide element and do not form any projecting parts that could cause injuries to persons or damage to road vehicles when accidents occur.

Rivets, clamps or screws, which are driven into the road surface, can be used as the fixing elements.

A preferred embodiment of the barrier elements according to the invention is characterized in that the fixing means are fitted in the interior of the barrier element. This has the advantage that there is great freedom in the type of fixing means and the way in which said fixing means are fixed on the barrier element, preferably with the guide element.

A preferred embodiment of a barrier element according to the invention is characterized in that the fixing means comprise a base plate that is provided with feed-through holes. In this embodiment the base plate, which has already been fitted as part of the tenon and mortise connecting system, is also used as a fixing means. As a result, few or no additional parts need be placed in the barrier element. Apart from the abovementioned elements, hook-shaped or strip-shaped elements that interact with the base plate can also be used as the fixing elements. Moreover, it is conceivable to fit an fixing plate as the fixing means if the base plate is not suitable for this purpose.

A further embodiment of the barrier element according to the invention is characterized in that the fixing means comprise a feed-through bush accommodated between the base plate and the foot part. The feed-through bush connects the base plate to the foot part and thereby forms a rigid construction. This makes it possible to achieve a more stable fixing in the barrier element relative to the road surface.

A further embodiment of a barrier element according to the invention is characterized in that the fixing means are fitted near the guide element.

Fitting the fixing means on or near the guide element ensures that the fixed barrier element can absorb a great force if a road vehicle crashes against it. If the fixing means comprise a plate, the holes are preferably made in the plate or base plate near the tenons and/or mortises of the tenon and mortise system. For the sake of stability, the holes are preferably made with as great spacing between them as is practically possible.

BRIEF DESCRIPTION OF THE DRAWINGS

The invention will be explained below with reference to a drawing of a non-limiting exemplary embodiment. In the drawing.

DETAILED DESCRIPTION OF THE INVENTION

Figure 1:
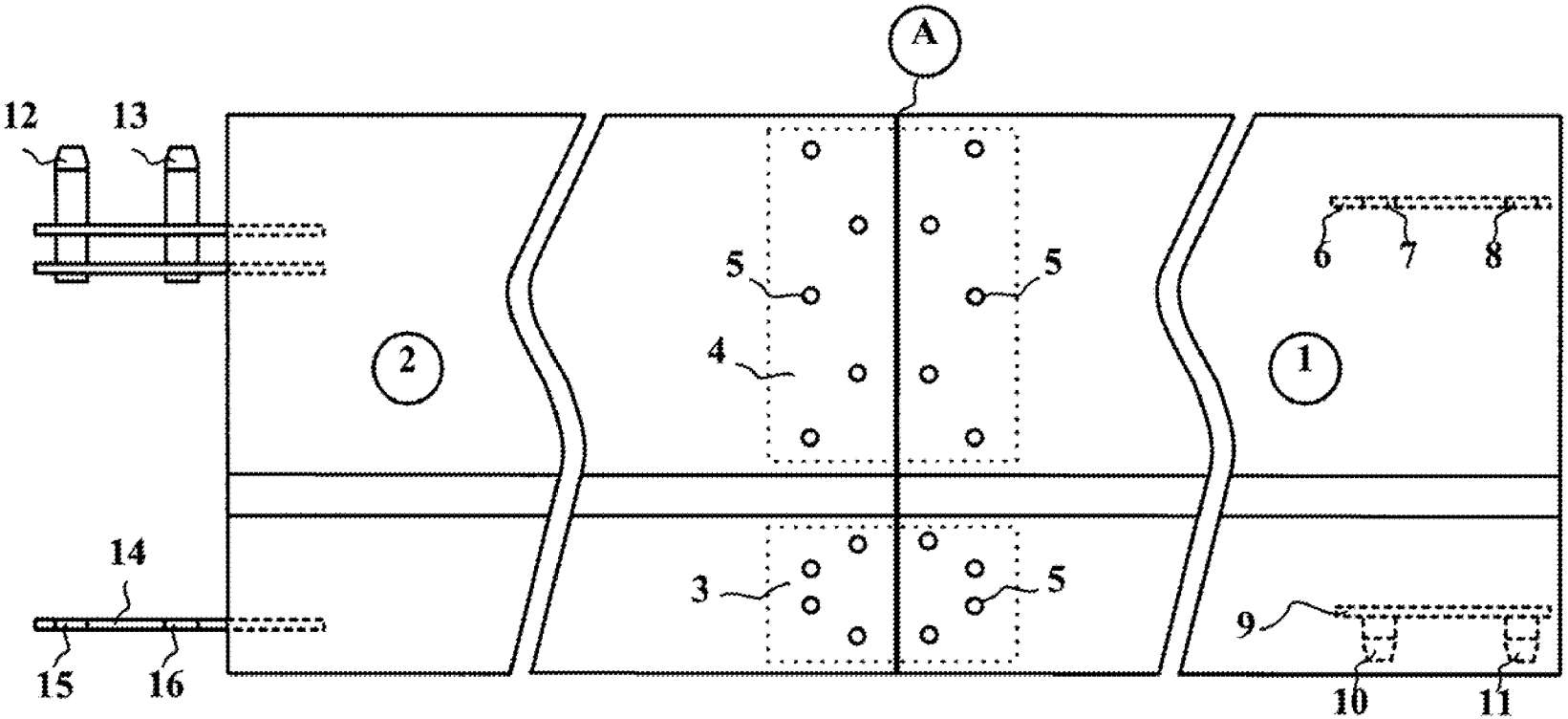
Fig. 1 (Prior Art)
FIG. 1 shows an assembly of two barrier elements.

In FIG. 1 reference numeral 1 shows a first barrier element of the prior art. The barrier elements 1 and 2 are connected to each other in the known manner at position A by means of connecting plates 3 and 4 (shown by dotted lines) and fixing bolts 5. The pre-connection of barrier elements to form an assembly is carried out in order to make bends and to simplify the replacement of a damaged barrier element.

The assembly of two barrier elements has, for example, an overall length of 12 meters and a weight of approximately 1,000–1,500 kg; the height of the assembly is approximately 80 cm, and the width of the foot is approximately 54 cm. These values are purely indicative and are not limiting.

Barrier element 1 has on its right-hand free end (viewed in the drawing) on the inside a first plate 6, which is provided with holes 7 and 8 positioned in a row in the longitudinal direction.

A second plate 9 is fitted on the free end in the bottom of the barrier element 1, on which second plate four tenons are fixed, two of which tenons 10 and 11 are shown. The four tenons are preferably fitted on the corner points of a rectangle.

Barrier element 2 has two tenons 12 and 13 at the top on its left-hand free end (viewed in the drawing). A plate 14 with six holes, two of which holes 15 and 16 are shown, is fitted near the foot 32. Four of these holes are preferably fitted on the corner points of a rectangle.

A road can be fenced off by connecting the right-hand part of the assembly to the left-hand part of a second assembly of two or more barrier elements or to a single barrier element, as show in FIG. 1.

Figure 2:
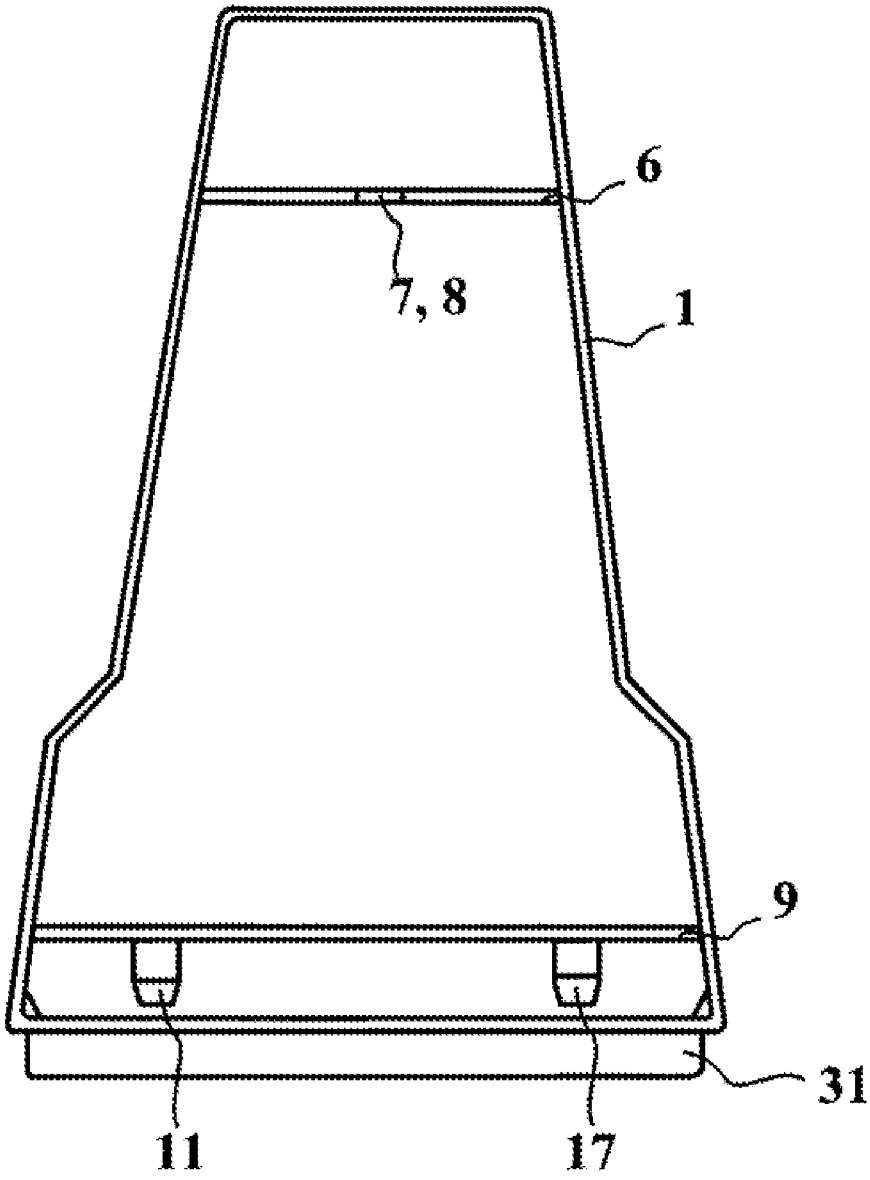
Fig. 2 (Prior Art)
FIG. 2 shows a view of one end of a barrier element according to the prior art.

FIG. 2 shows, for the sake of clarity, the view of the free end of the barrier element 1. The first plate 6 with the holes 7 and 8 positioned in a row in it is fitted at the top. The second plate 9 with tenons 11 (see FIG. 1) and 17 on it is fitted on the foot end.

Figure 3:
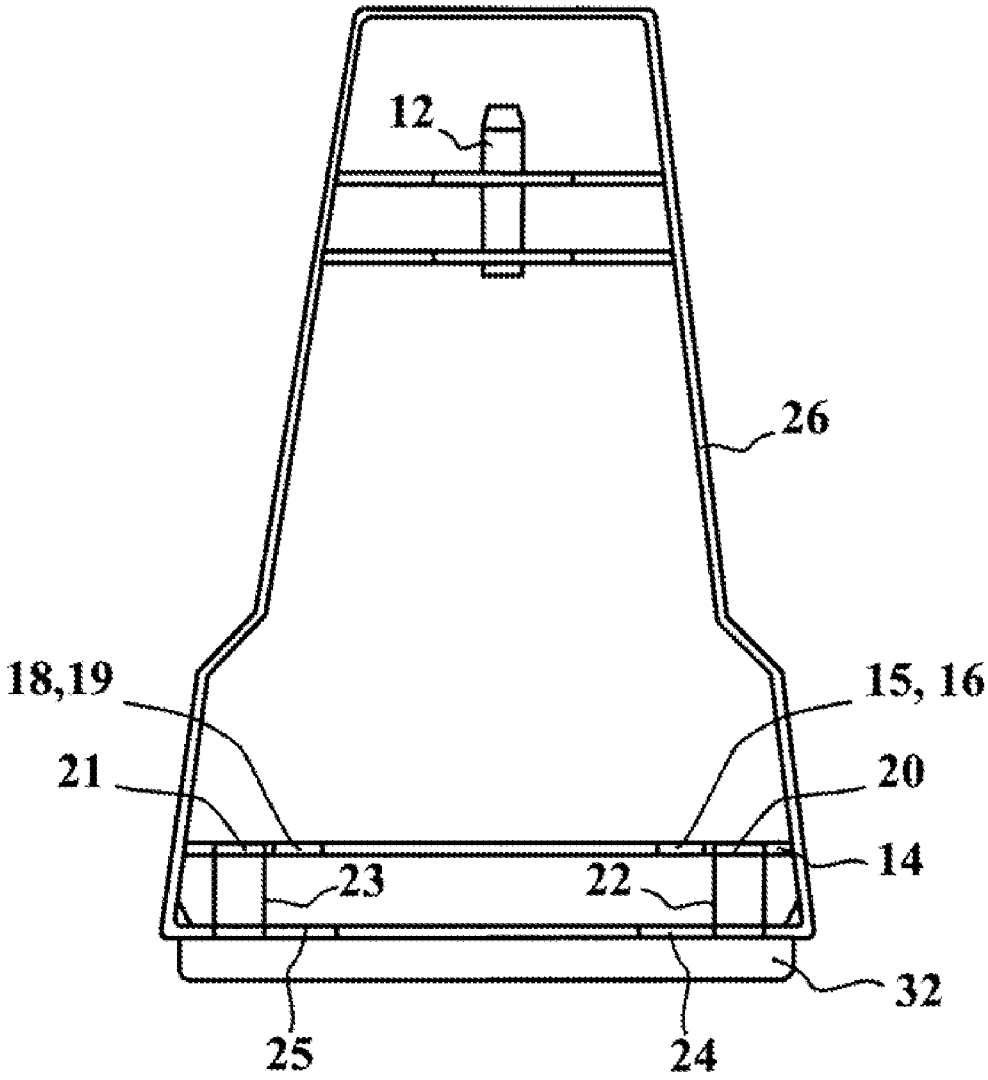
FIG. 3 shows a view of one end of a barrier element according to the invention.

FIG. 3 shows the free end of the barrier element 2, wherein plate 14 is modified according to an embodiment of the present invention to have two holes 20 and 21 and bushes 22, 23. Tenon 12 is visible again in the top of it. The plate 14 with the holes 15, 16 (see FIG. 1) positioned in a row and the holes 18, 19 positioned in a row in it is fitted on the foot end.

According to one embodiment of the invention, the plate 14, which is the base plate here, is also provided with two holes 20 and 21. Bushes 22 and 23, which are connected to the flanged bottom edges 24 and 25 of the guide element 26 of the-barrier element, are provided below the holes. A bolt, nail, rivet or other suitable fixing means is passed through the holes 20, 21, bushes 22, 23 and holes in the flanged bottom edge 24 and 25 and is anchored in the road surface. The fixing is preferably carried out before another barrier element or assembly of barrier elements is connected to the free end with the tenon and mortise connecting system.

Figure 4:
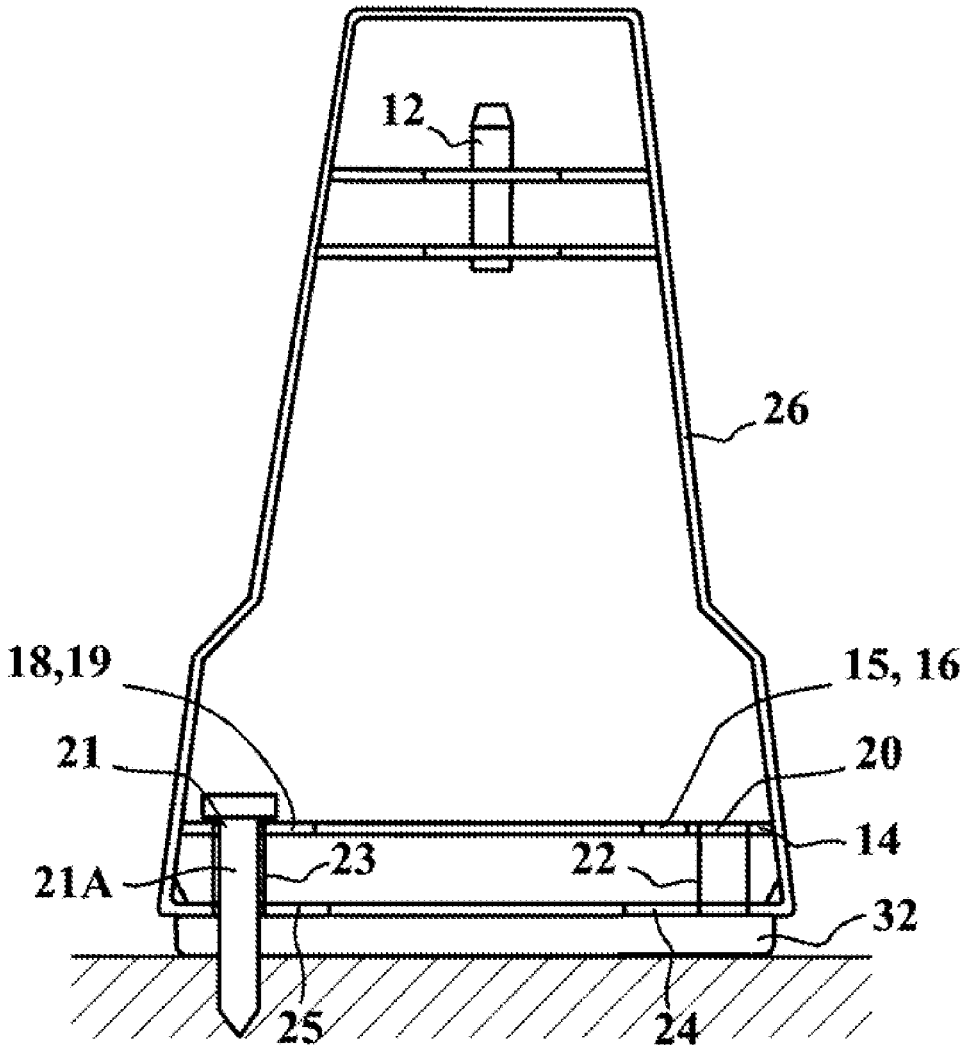
FIG. 4 shows the view of FIG. 3 together with a carriageway and a fixing element, namely a nail, attaching the barrier element to a road surface.

FIG. 4 shows the view of FIG. 3 together with a carriageway and a fixing element, namely a nail, attaching the barrier element to the surface of the road.

Figure 5:
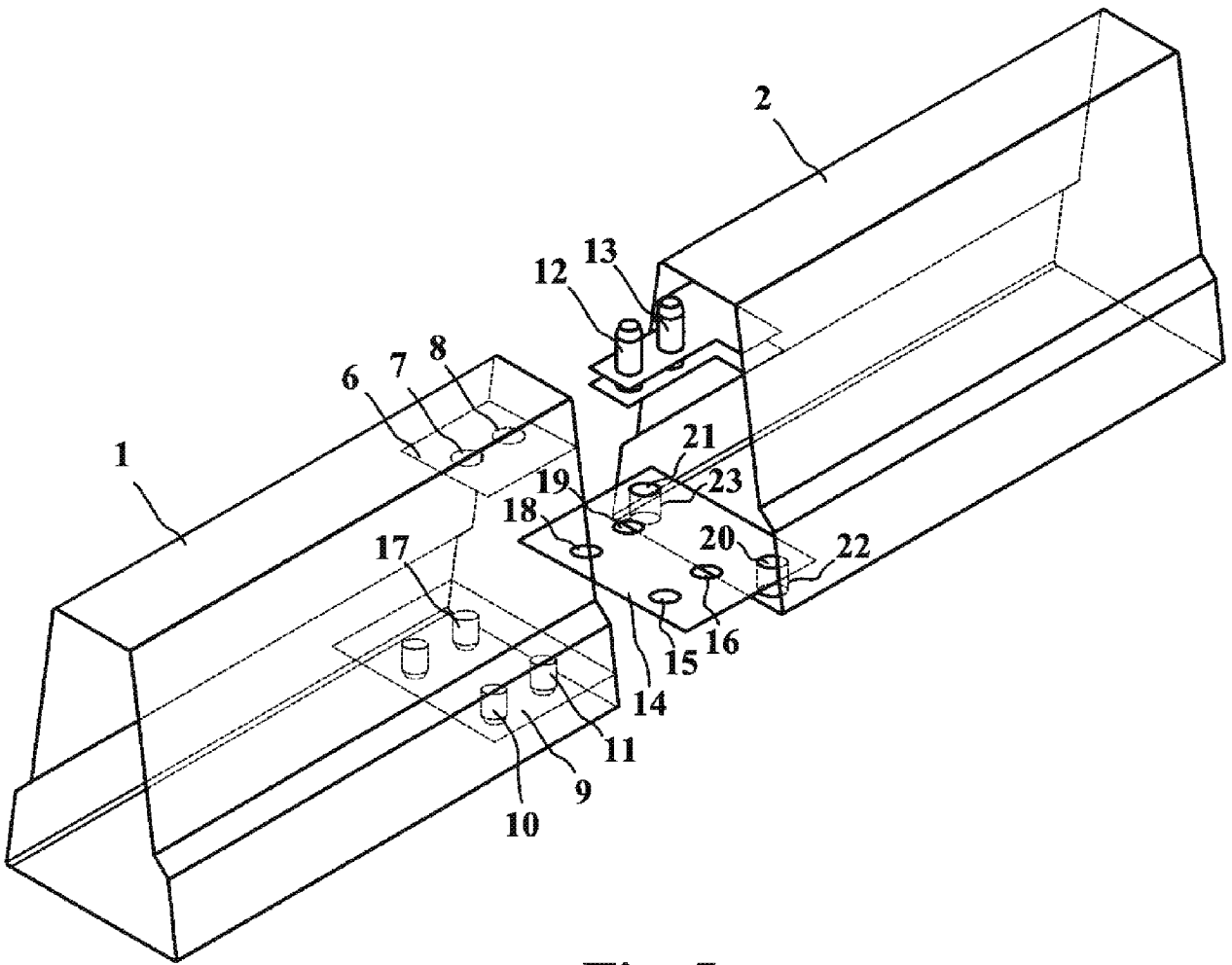
FIG. 5 shows a perspective view of two connectable barrier elements of FIGS. 2 and 3.
Figure 6:
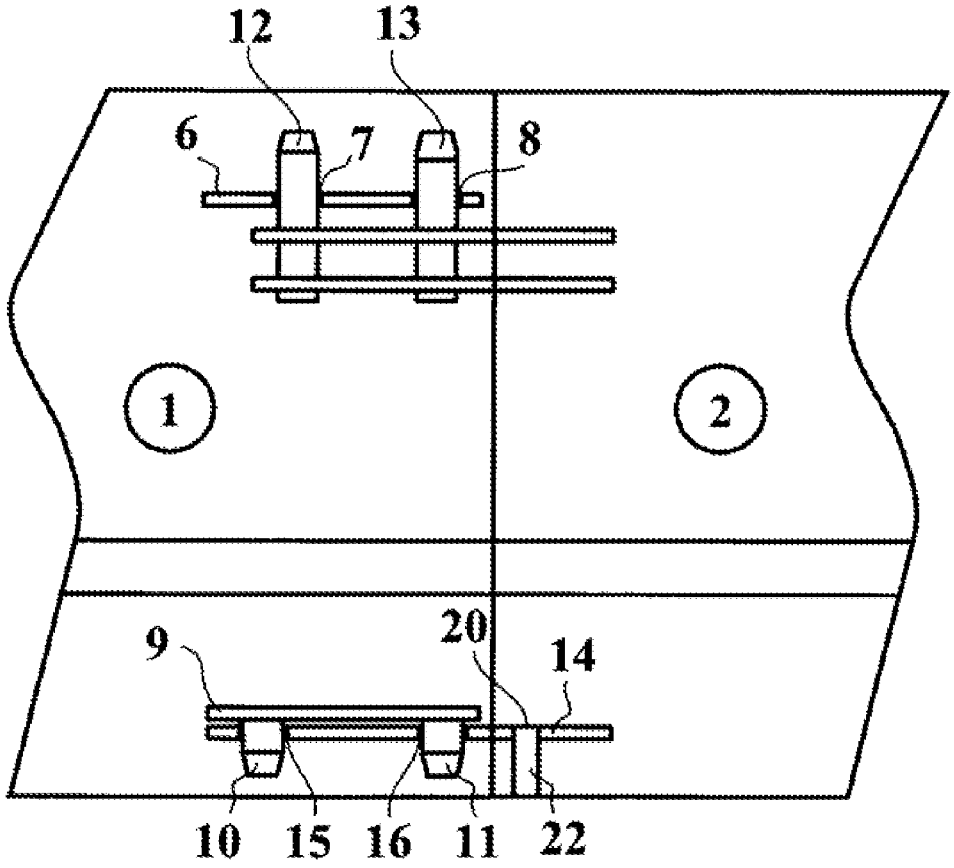
FIG. 6 shows a side partial cross-sectional view of connected barrier elements of FIGS. 2 and 3.

FIG. 5 shows a perspective view of two connectable barrier elements 1, 2 of FIGS. 2 and 3. FIG. 6 shows a partial cross-sectional side view to show a mortise and tenon connection of barrier elements 1, 2 of FIGS. 2 and 3. The holes 7, 8, 15, 16, respectively, provide a mortise connected to the tenons 12, 13, 10, 11. Foot parts 31, 32 of FIGS. 2 and 3 are present in the embodiment of FIGS. 5 and 6 but are not shown in FIGS. 5 and 6. Likewise, foot parts 31, 32 of FIGS. 2 and 3 are present in the embodiment of FIG. 1 but are not shown in FIG. 1.

With the invention it is advantageously possible for the existing base plate also to be used to fix a base element relative to the carriageway.

The invention claimed is:

1. An apparatus comprising:

a first barrier element for bounding a carriageway, said first barrier element comprising:

a guide element extending along a longitudinal axis, the guide element comprising a foot part located on an underside of the guide element transversely to the longitudinal axis of the guide element, wherein the foot part is provided with a base plate on a first end of the guide element, a second end of the guide element enclosing a first interior space, the base plate comprising parts of a first tenon and mortise connecting system as a first connecting means for connecting the first barrier element to a second barrier element, a second barrier element comprising second connecting means comprising parts of a second tenon and mortise system of the second barrier element for interacting with the first connecting means, wherein fixing means for accommodating a fixing element for fixing the first barrier element relative to the carriageway is provided on the first end of the first barrier element, and wherein the fixing means comprises a fixing plate provided with feed-through holes, wherein the base plate and the fixing plate may be the same plate or different plates.

2. The apparatus according to claim 1, wherein the fixing plate is the base plate.

3. The apparatus according to claim 1, wherein the fixing means comprise a feed-through bush between the fixing plate and the foot part.

4. The apparatus according to claim 1, wherein the fixing means are fitted near the guide element.

5. The apparatus element according to claim 1, wherein the holes of the fixing plate are within the interior of the second barrier element.

6. The apparatus according to claim 1, wherein the second connecting means is located within a second interior space of the second barrier element.

7. The apparatus according to claim 6, wherein the base plate and the fixing plate are the same plate, and there are six holes therein, two of which are fitted near the foot.

8. The apparatus according to claim 7, wherein four of the remaining six holes in the base plate are fitted on the corner points of a rectangle.

9. The apparatus according to claim 3, wherein the foot part of the guide element has flanged bottom edges provided below the feed-through holes of the fixing plate, and the fixing means includes one of a bolt, nail, and rivet that can be arranged to pass through one of the feed-through holes and its associated feed-through bush to fix the first barrier element to the carriageway.

10. The apparatus according to claim 1, further comprising the fixing element and the carriageway, wherein the first barrier element is fixed to the carriageway by the fixing element, wherein one portion of the fixing element is fixed in a respective said feed through hole of the fixing plate, and another portion of the fixing element is attached to the carriageway.

11. The apparatus according to claim 10, wherein the fixing element is selected from the group consisting of bolts, nails, rivets, clamps and screws.

12. The apparatus according to claim 10, wherein the fixing element comprises a nail.

13. A barrier element for bounding a carriageway comprising:

a guide element extending along a longitudinal axis, the guide element includes a foot part located on an underside of the guide element transversely to the longitudinal axis of the guide element, the guide element having a left end and a right end along said longitudinal axis, wherein the foot part is provided with a base plate having a fixing portion that extends from one of the left end and right end of the guide element, and the fixing portion has at least one feed-through hole therein to permit a fixing element to pass through the hole and secure the barrier element to the carriageway, and wherein the base plate further comprises a tenon and mortise connection system having one of a tenon and a mortise arranged in the fixing portion extending from one of the left end or right end of the guide element, and the other of the tenon and mortise being arranged in the base plate at the other of the left end or right end of the guide element, so that the barrier element is connectable via the tenon and mortise arrangement to another barrier element.

14. The apparatus according to claim 13, further comprising the fixing element and the carriageway, wherein the first barrier element is fixed to the carriageway by the fixing element, wherein one portion of the fixing element is fixed in a respective said feed through hole of the fixing plate, and another portion of the fixing element is attached to the carriageway.

15. The apparatus according to claim 12, wherein the fixing element is selected from the group consisting of bolts, nails, rivets, clamps and screws.

16. The apparatus according to claim 12, wherein the fixing element comprises a nail.

* * * * *